US009262992B2

(12) United States Patent
Sun et al.

(10) Patent No.: US 9,262,992 B2
(45) Date of Patent: Feb. 16, 2016

(54) MULTIPLE HARDWARE PATHS FOR BACKLIGHT CONTROL IN COMPUTER SYSTEMS

(71) Applicant: Apple Inc., Cupertino, CA (US)

(72) Inventors: Adrian E. Sun, Mountain View, CA (US); Craig H. Prouse, Mountain View, CA (US); Maciej Maciesowicz, Gilroy, CA (US); Meng Chi Lee, Los Altos, CA (US); Siji Menokki Kandiyil, San Jose, CA (US)

(73) Assignee: Apple Inc., Cupertino, CA (US)

( * ) Notice: Subject to any disclaimer, the term of this patent is extended or adjusted under 35 U.S.C. 154(b) by 236 days.

(21) Appl. No.: 13/717,317

(22) Filed: Dec. 17, 2012

(65) Prior Publication Data

US 2014/0091999 A1 Apr. 3, 2014

Related U.S. Application Data

(60) Provisional application No. 61/707,519, filed on Sep. 28, 2012.

(51) Int. Cl.

| | |
|---|---|
| ***G09G 3/36*** | (2006.01) |
| ***G09G 5/10*** | (2006.01) |
| ***G09F 13/04*** | (2006.01) |
| ***G09G 3/34*** | (2006.01) |

(52) U.S. Cl.

CPC *G09G 5/10* (2013.01); *G09F 13/04* (2013.01); *G09G 3/3406* (2013.01)

(58) Field of Classification Search

CPC ..... G09G 5/10; G09G 3/3406; G09F 13/04
USPC ..... 345/102
See application file for complete search history.

(56) References Cited

U.S. PATENT DOCUMENTS

| | | | | |
|---|---|---|---|---|
| 2004/0150582 | A1* | 8/2004 | Dunn | G09G 3/20 345/1.3 |
| 2008/0136844 | A1* | 6/2008 | Takada | G09G 3/3406 345/690 |
| 2009/0063845 | A1* | 3/2009 | Lin | G06F 1/3203 713/100 |
| 2012/0099020 | A1* | 4/2012 | Adams | H04B 1/0458 348/552 |

FOREIGN PATENT DOCUMENTS

JP 2012008515 A * 1/2012

* cited by examiner

*Primary Examiner* — Carolyn R Edwards
(74) *Attorney, Agent, or Firm* — Joseph F. Guihan

(57) ABSTRACT

The disclosed embodiments provide a system that drives a display from a computer system. The system includes a first hardware path for controlling a backlight of a display of the computer system. The system also includes a second hardware path for controlling the backlight. Finally, the system includes a backlight controller that enables use of the first and second hardware paths in controlling the backlight from the computer system.

22 Claims, 5 Drawing Sheets

MULTIPLE HARDWARE PATHS FOR BACKLIGHT CONTROL IN COMPUTER SYSTEMS

RELATED APPLICATION

This application hereby claims priority under 35 U.S.C. §119 to U.S. Provisional Application No. 61/707,519, entitled "Multiple Hardware Paths for Backlight Control in Computer Systems" by inventors Adrian E. Sun, Craig H. Prouse, Maciej Maciesowicz, Meng Chi Lee and Siji Menokki Kandiyil, filed 28 Sep. 2012.

BACKGROUND

1. Field

The disclosed embodiments relate to techniques for driving displays from computer systems. More specifically, the disclosed embodiments relate to techniques for providing multiple hardware paths for controlling a backlight of a display in a computer system.

2. Related Art

Interactions between a user and a computer system may be facilitated by a display of the computer system. For example, a liquid crystal display (LCD) panel of a laptop computer may allow the user of the laptop computer to view graphical user interfaces (GUIs) for an operating system and/or one or more applications executing on the laptop computer. One or more attributes of the display may also be dynamically adjusted and/or configured during use of the computer system. For example, the operating system may adjust the brightness of the display by transmitting commands that modify the duty cycle and/or frequency associated with pulse-width modulation (PWM) of power to the display's backlight.

On the other hand, native support for backlight control in the computer system may not be compatible with all operating systems on the computer system. For example, the computer system may be a multi-boot computer system with hardware that supports backlight control through a graphics-processing unit (GPU) of the computer system. As a result, a first operating system that is compatible with the hardware may issue backlight control commands to the GPU, while a second operating system that uses Advanced Configuration and Power Interface (ACPI) for backlight control may be unable to interface with the GPU to control the backlight.

In addition, conventional mechanisms for enabling backlight control for operating systems that are not natively supported by backlight control hardware may be intrusive and/or associated with significant overhead. Continuing with the above example, an ACPI command for backlight control from the second operating system may be trapped before the command is translated into a GPU-compatible command that is then is transmitted to the GPU. Such trapping of the command may cause the operating system to freeze, resulting in noticeable performance degradation during processing of long sequences of backlight control commands from the operating system and/or the delayed processing of some backlight control commands from the sequences.

Hence, what is needed is a mechanism for reducing overhead associated with providing backlight control to operating systems that are unable to use natively supported backlight control mechanisms in computer systems.

SUMMARY

The disclosed embodiments provide a system that drives a display from a computer system. The system includes a first hardware path for controlling a backlight of a display of the computer system. The system also includes a second hardware path for controlling the backlight. Finally, the system includes a backlight controller that enables use of the first and second hardware paths in controlling the backlight from the computer system.

In some embodiments, enabling use of the first and second hardware paths in controlling the backlight involves receiving commands for the backlight over the first and second hardware paths, and processing the commands based on a prioritization scheme associated with the first and second hardware paths. For example, the commands may be buffered and sent to a command processor in the backlight controller according to a round-robin prioritization scheme.

In some embodiments, the commands are associated with a pulse-width modulation of the backlight. For example, the commands may change the frequency and/or duty cycle associated with PWM of power to the backlight.

In some embodiments, the commands are further received over a set of identical interfaces connected to the first and second hardware paths. For example, the commands may be received over the first and second hardware paths by a set of $I^2C$ ports with the same $I^2C$ address on the backlight controller.

In some embodiments, the first hardware path includes an auxiliary path from a graphics-processing unit (GPU) to the backlight controller. For example, the first hardware path may include a DisplayPort (DP) auxiliary path that connects the GPU to a timing controller (TCON) associated with the backlight controller.

In some embodiments, the second hardware path includes a path from a motherboard to the backlight controller. For example, the second hardware path may include an $I^2C$ path that connects a Platform Controller Hub (PCH) on the motherboard with the backlight controller.

In some embodiments, the first and second hardware paths are used by different operating systems on the computer system to control the backlight. For example, the first hardware path may be used by an operating system with native support for transmitting backlight control commands to the GPU, and the second hardware path may be used by a legacy operating system that lacks such native support.

In some embodiments, the first and second hardware paths are accessed by the different operating systems using different application programming interfaces (APIs).

BRIEF DESCRIPTION OF THE FIGURES

In the figures, like reference numerals refer to the same figure elements.

DETAILED DESCRIPTION

The following description is presented to enable any person skilled in the art to make and use the embodiments, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present invention is not limited to the embodiments shown, but is to be accorded the widest scope consistent with the principles and features disclosed herein.

The data structures and code described in this detailed description are typically stored on a computer-readable storage medium, which may be any device or medium that can store code and/or data for use by a computer system. The computer-readable storage medium includes, but is not limited to, volatile memory, non-volatile memory, magnetic and optical storage devices such as disk drives, magnetic tape, CDs (compact discs), DVDs (digital versatile discs or digital video discs), or other media capable of storing code and/or data now known or later developed.

The methods and processes described in the detailed description section can be embodied as code and/or data, which can be stored in a computer-readable storage medium as described above. When a computer system reads and executes the code and/or data stored on the computer-readable storage medium, the computer system performs the methods and processes embodied as data structures and code and stored within the computer-readable storage medium.

Furthermore, methods and processes described herein can be included in hardware modules or apparatus. These modules or apparatus may include, but are not limited to, an application-specific integrated circuit (ASIC) chip, a field-programmable gate array (FPGA), a dedicated or shared processor that executes a particular software module or a piece of code at a particular time, and/or other programmable-logic devices now known or later developed. When the hardware modules or apparatus are activated, they perform the methods and processes included within them.

The disclosed embodiments provide a method and system for driving a display from a computer system. The computer system may correspond to a laptop computer, personal computer, workstation, and/or portable electronic device. The display may be a cathode ray tube (CRT) display, liquid crystal display (LCD), plasma display, organic light-emitting diode (OLED) display, surface-conducting electron-emitter display (SED), and/or other type of electronic display.

Figure 1:
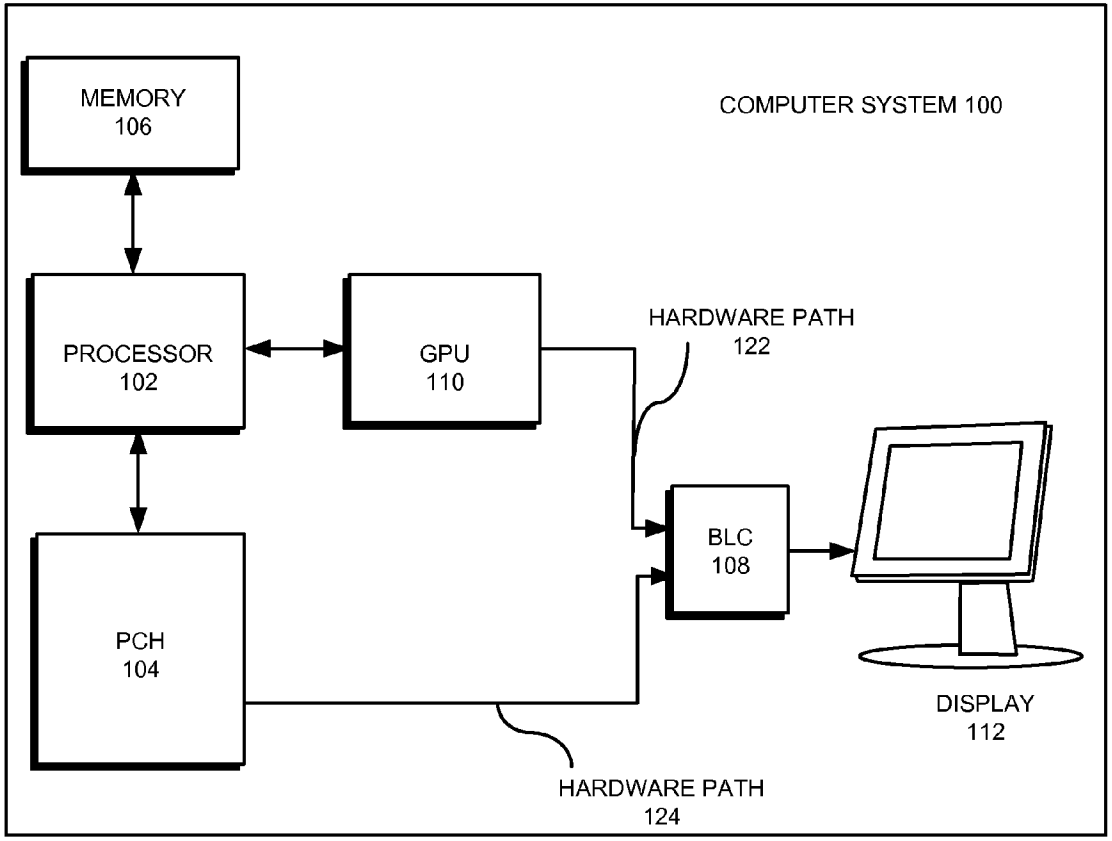
FIG. 1 shows the driving of a display from a computer system in accordance with the disclosed embodiments.

As shown in FIG. 1, a computer system 100 includes a processor 102 that is coupled to a Platform Controller Hub (PCH) 104 and/or other type of bridge chip and a memory 106 subsystem containing semiconductor memory. In addition, processor 102 may communicate with a display 112 (e.g., an integrated display) through a graphics-processing unit (GPU) 110. For example, processor 102 may be connected to GPU 110 through an interface such as Peripheral Component Interconnect Express (PCIe). GPU 110 may perform various graphical processing operations to produce video frames that are used to drive display 112.

Processor 102 may also configure and/or adjust a backlight (not shown) of display 112 during driving of display 112 by GPU 110. For example, an operating system executing on processor 102 may control the brightness of the backlight by issuing backlight control commands to GPU 110, which transmits the commands over a hardware path 122 to a backlight controller (BLC) 108 that adjusts the frequency and/or duty cycle associated with pulse-width modulation (PWM) of the backlight based on the commands. In other words, processor 102 may use a set of natively supported backlight control mechanisms on computer system 100 to adjust the backlight.

Conversely, the operating system executing on processor 102 may be unable to use the natively supported backlight control mechanisms. For example, processor 102 may use a driver for GPU 110 to transmit backlight control commands to GPU 110. As a result, an operating system executing on processor 102 may be unable to control the backlight through GPU 110 if the driver used by the operating system is not configured to transmit backlight control commands to GPU 110. To enable backlight control for the operating system, a basic input/output system (BIOS) on computer system 100 may trap backlight control commands from the operating system so that the commands may be translated into commands that are compatible with GPU 110 and/or used to write to a Legacy Backlight Brightness (LBB) register for computer system 100.

However, such trapping and processing of backlight control commands that are incompatible with GPU 110 and/or hardware path 122 may be associated with significant overhead and/or interference to the execution of the operating system. For example, trapping of each backlight control command from the operating system may cause the operating system to freeze until the backlight control command is translated and/or otherwise processed. Such freezing of the operating system may further result in noticeable performance degradation during processing of long sequences of backlight control commands from the operating system and/or the delayed processing of some backlight control commands from the sequences.

In one or more embodiments, computer system 100 includes functionality to accommodate operating systems that utilize different backlight control mechanisms by providing multiple hardware paths 122-124 for controlling the backlight. In particular, computer system 100 may include an additional hardware path 124 to BLC 108 from PCH 104 and/or another component on the motherboard of computer system 100 that allows an operating system to control the backlight without communicating with GPU 110. For example, hardware path 124 may allow Advanced Configuration and Power Interface (ACPI) commands for backlight control from the operating system to PCH 104 to be relayed from PCH 104 to BLC 108. As a result, hardware paths 122-124 may allow operating systems on computer system 100 to control the backlight through different application programming interfaces (APIs). Hardware paths 122-124 are discussed in further detail below with respect to FIGS. 3-4.

BLC 108 may additionally enable simultaneous use of both hardware paths 122-124 in controlling the backlight. For example, BLC 108 may receive backlight control commands from both hardware paths 122-124 and process the commands based on a prioritization scheme associated with hardware paths 122-124, such as a round-robin prioritization scheme. The operation of BLC 108 is discussed in further detail below with respect to FIG. 2.

Figure 2:
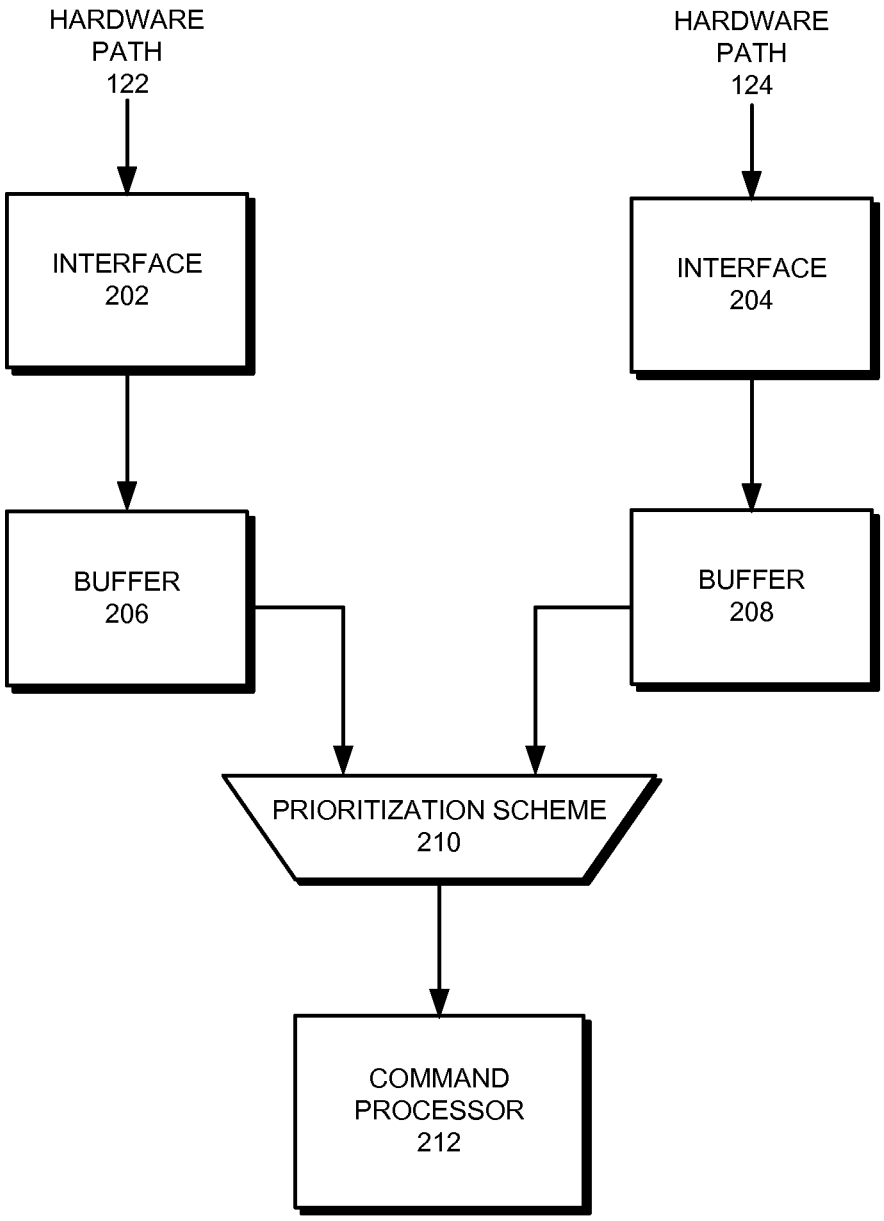
FIG. 2 shows the operation of a backlight controller in accordance with the disclosed embodiments.

FIG. 2 shows the operation of a BLC (e.g., BLC 108 of FIG. 1) in accordance with the disclosed embodiments. As mentioned above, the BLC may be used to control a backlight of a display in a computer system by processing commands for controlling the backlight from one or more operating systems in the computer system. For example, the BLC may include a microcontroller that communicates with a driver for the backlight to adjust the duty cycle and/or frequency associated with pulse-width modulation (PWM) of power to the backlight. In addition, the commands may be transmitted from the operating system(s) to the BLC over two hardware paths 122-124.

As shown in FIG. 2, the commands may be received over a set of interfaces 202-204 connected to hardware paths 122-124. In one or more embodiments, interfaces 202-204 are identical interfaces that accept commands with the same packet format from hardware paths 122-124. For example, interfaces 202-204 may be Inter-Integrated Circuit ($I^2C$) interfaces that are provided by two $I^2C$ slave ports with the same $I^2C$ address (e.g., 37) on the BLC. Because packets received over interfaces 202-204 are transmitted over separate hardware paths 122-124 that are accessed using different APIs, the shared address may not present a conflict to the operating system(s) and/or within the computer system.

After the commands are received, the commands may be placed into buffers 206-208 and processed according to a prioritization scheme 210. For example, the BLC may parse the commands into Monitor Command Control Set (MCCS) packets and send valid MCCS packets to a command processor 212 for the backlight using a round-robin prioritization scheme. Alternatively, the BLC may prioritize commands from one hardware path over those of the other hardware path by processing commands from the other hardware path only if no commands are received over the first hardware path.

Command processor 212 may then use the commands to adjust the duty cycle, frequency, and/or other attributes associated with PWM of the backlight. For example, command processor 212 may dim the backlight by gradually reducing the duty cycle of the backlight over a pre-specified period (e.g., a number of milliseconds). Values associated with the duty cycle, frequency, and/or other attributes of the backlight may then be written into known memory locations and/or used to generate interrupts that alert the operating system(s) and/or other processes of changes to the attributes.

Figure 3:
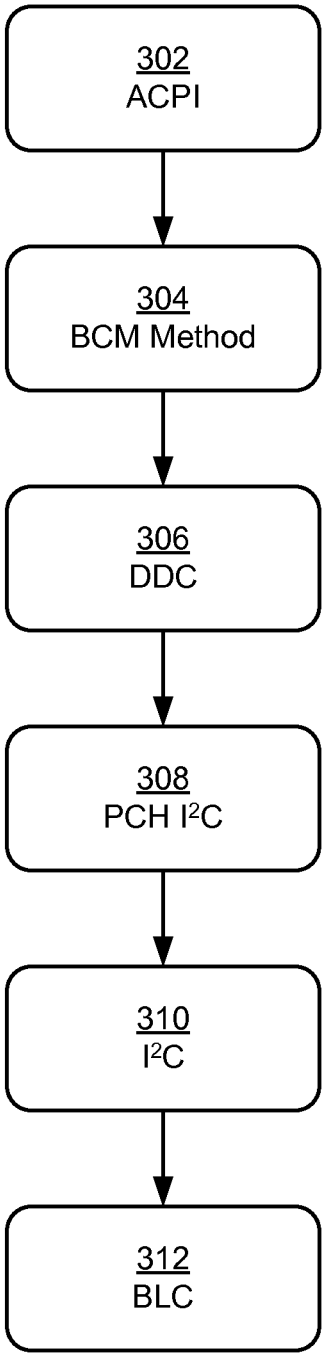
FIG. 3 shows the exemplary use of a hardware path in controlling a backlight in accordance with the disclosed embodiments.

FIG. 3 shows the exemplary use of a hardware path in controlling a backlight in accordance with the disclosed embodiments. More specifically, FIG. 3 shows a sequence of operations involved in the use of a hardware path such as hardware path 124 of FIG. 1. For example, the operations of FIG. 3 may be used by an operating system that lacks native support for communicating backlight control commands to a GPU.

First, an ACPI 302 specification may be used to call a BCM method 304 defined by ACPI 302 for backlight control. Next, BCM method 304 may be used to construct a Display Data Channel (DDC) 306 for controlling the brightness of the backlight.

DDC 306 may then be used to send a command to a PCH $I^2C$ 308 block of a PCH. PCH $I^2C$ 308 may format the command as an $I^2C$ packet and transmit the $I^2C$ packet over an $I^2C$ 310 interface with a BLC 312 for the backlight. For example, the command may be transmitted between the PCH and BLC 312 over hardware path 124 of FIG. 1. Such use of well-known APIs and/or interfaces such as ACPI 302 and/or $I^2C$ 310 in controlling the backlight may allow the command to be generated, transmitted, and processed by BLC 312 without trapping the command and/or requiring extensive modification to the operating system and/or BLC 312.

Figure 4:
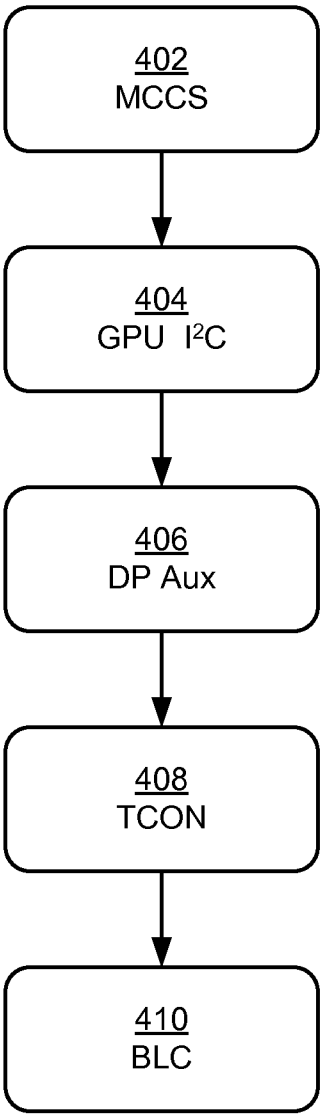
FIG. 4 shows the exemplary use of a hardware path in controlling a backlight in accordance with the disclosed embodiments.

FIG. 4 shows the exemplary use of a hardware path in controlling a backlight in accordance with the disclosed embodiments. More specifically, FIG. 4 shows a sequence of operations involved in the use of a hardware path such as hardware path 122 of FIG. 1. For example, the operations of FIG. 4 may be used by an operating system that is capable of using natively supported mechanisms for backlight control in a computer system.

First, MCCS 402 is used to transmit a command to a GPU $I^2C$ 404 module on a GPU of the computer system. Next, the command is sent from the GPU over a DisplayPort (DP) auxiliary path 406 that operates as a sideband channel for display configuration and control to a timing controller (TCON) 408 for the backlight and/or display. For example, the command may be formatted as an $I^2C$ packet by the GPU before transmission of the command over DP auxiliary path 406 to TCON 408. Finally, the command is sent from TCON 408 to a BLC 410 for the backlight for processing by BLC 410. In other words, use of the hardware path may involve generation, transmission, and processing of the command using GPU- and/or platform-native interfaces and/or APIs.

Figure 5:
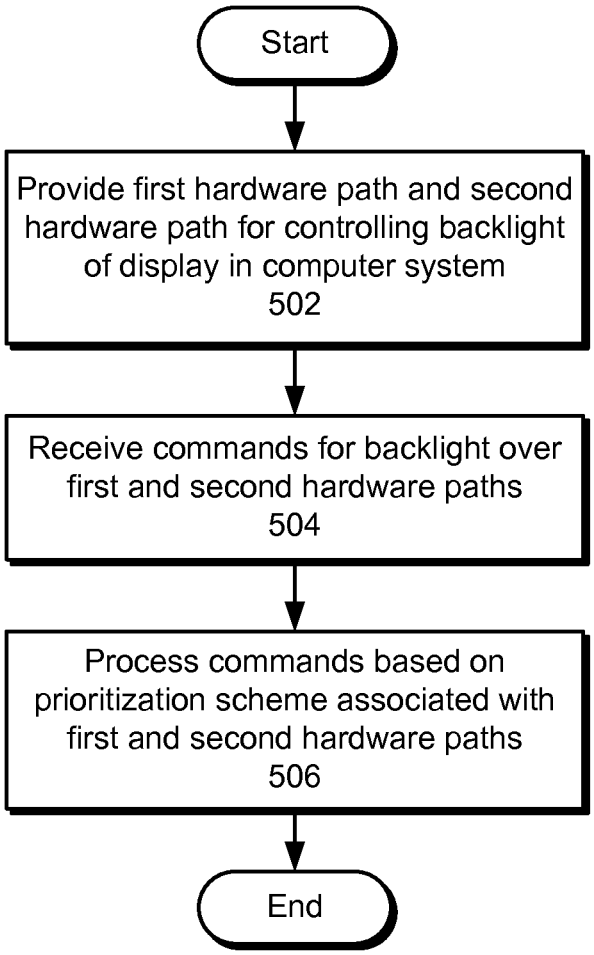
FIG. 5 shows a flowchart illustrating the process of driving a display from a computer system in accordance with the disclosed embodiments.

FIG. 5 shows a flowchart illustrating the process of driving a display from a computer system in accordance with the disclosed embodiments. In one or more embodiments, one or more of the steps may be omitted, repeated, and/or performed in a different order. Accordingly, the specific arrangement of steps shown in FIG. 5 should not be construed as limiting the scope of the embodiments.

Initially, a first hardware path and a second hardware path for controlling the backlight of a display in the computer system are provided (operation 502). The first hardware path may include an auxiliary path from a GPU to a BLC in the display, and the second hardware path may include a path from a motherboard to the BLC. As a result, the first and second hardware paths may be used by different operating systems on the computer system (e.g., a multi-boot computer system) to control the backlight. For example, the first and second hardware paths may be accessed by the operating systems using different APIs (e.g., ACPI, MCCS, etc.).

Next, use of the first and second hardware paths in controlling the backlight from the computer system is enabled. In particular, commands for the backlight are received over the first and second hardware paths (operation 504). The commands may be received over a set of identical interfaces connected to the first and second hardware paths, such as $I^2C$ interfaces. In addition, the commands may be associated with PWM of the backlight. For example, the commands may change the frequency and/or duty cycle associated with PWM of power to the backlight.

The commands are then processed based on a prioritization scheme associated with the first and second hardware paths (operation 506). For example, the commands may be buffered and sent to a command processor for the backlight according to a round-robin prioritization scheme. Alternatively, commands from one hardware path may be prioritized over commands from another hardware path.

The foregoing descriptions of various embodiments have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention.

What is claimed is:

1. A system for driving a display from a computer system, comprising:

a first hardware path for controlling a backlight of a display of the computer system;

a second hardware path for controlling the backlight; and a backlight controller coupled to the first hardware path and the second hardware path, wherein the backlight controller is configured to enable use of the first and second hardware paths in controlling the backlight from the computer system, wherein the first and the second hardware paths control the backlight independently of each other, wherein the first and second hardware paths are both configured to send commands to the backlight controller, wherein the first hardware path comprises an auxiliary path from a graphics-processing unit (GPU) to the backlight controller, and wherein the second hardware path comprises a path without a graphics-processing unit from a motherboard to the backlight controller.

2. The system of claim 1, wherein enabling use of the first and second hardware paths in controlling the backlight involves:

receiving commands for the backlight over the first and second hardware paths; and processing the commands based on a prioritization scheme associated with the first and second hardware paths.

3. The system of claim 2, wherein one or more of the commands comprise a pulse-width modulation of the backlight.

4. The system of claim 2, wherein the commands are further received over a set of identical interfaces connected to the first and second hardware paths.

5. The system of claim 1, wherein the first and second hardware paths are used by different operating systems on the computer system to control the backlight.

6. The system of claim 5, wherein the first and second hardware paths are accessed by the different operating systems using different application programming interfaces (APIs).

7. A computer system, comprising:

a display comprising a backlight;

a first hardware path for controlling the backlight, wherein the first hardware path enables the backlight to illuminate a first area of the display;

a second hardware path for controlling the backlight, wherein the second hardware path enables the backlight to illuminate a second area of the display, and wherein the second area at least partially overlaps the first area; and a backlight controller configured to enable use of the first and second hardware paths in controlling the backlight, wherein the first and the second hardware paths control the backlight independently of each other.

8. The computer system of claim 7, wherein enabling use of the first and second hardware paths in controlling the backlight involves:

receiving commands for the backlight over the first and second hardware paths; and processing the commands based on a prioritization scheme associated with the first and second hardware paths.

9. The computer system of claim 8, wherein one or more of the commands comprise a pulse-width modulation of the backlight.

10. The computer system of claim 8, wherein the commands are further received over a set of identical interfaces connected to the first and second hardware paths.

11. The computer system of claim 7, wherein the first hardware path comprises an auxiliary path from a graphics-processing unit (GPU) to the backlight controller.

12. The computer system of claim 11, wherein the second hardware path comprises a path without a graphics-processing unit from a motherboard to the backlight controller.

13. The computer system of claim 7, wherein the first and second hardware paths are used by different operating systems on the computer system to control the backlight.

14. The computer system of claim 13, wherein the first and second hardware paths are accessed by the different operating systems using different application programming interfaces (APIs).

15. The computer system of claim 7, wherein the first area is the same as the second area.

16. A method of illuminating an area of a display with a backlight, the method comprising:

using a first hardware path, transmitting commands to a backlight controller from a graphics-processing unit to illuminate the area of the display;

using a second hardware path, transmitting additional commands to the backlight controller from a motherboard without communicating with the graphics-processing unit to illuminate the area of the display, wherein the first and the second hardware paths are configured to enable the backlight to illuminate the area of the display independently of each other; and with the backlight controller, receiving the commands and the additional commands and controlling the backlight to illuminate the area.

17. The method of claim 16, wherein controlling the backlight to illuminate the area with the backlight controller comprises:

processing the commands and the additional commands based on a prioritization scheme associated with the first and second hardware paths.

18. The method of claim 17, wherein the commands and the additional commands are associated with a pulse-width modulation of the backlight.

19. The method of claim 16, wherein the first hardware path comprises an auxiliary path from the graphics-processing unit to the backlight controller in the display.

20. The method of claim 19, wherein the second hardware path comprises a path without a graphics-processing unit from the motherboard to the backlight controller.

21. The method of claim 16, wherein the first and second hardware paths are used by different operating systems on the computer system to control the backlight.

22. The method of claim 21, wherein the first and second hardware paths are accessed by the different operating systems using different application programming interfaces (APIs).

* * * * *